US006640554B2

(12) United States Patent
Emmer et al.

(10) Patent No.: US 6,640,554 B2
(45) Date of Patent: Nov. 4, 2003

(54) CONTAINMENT MODULE FOR TRANSPORTABLE LIQUID NATURAL GAS DISPENSING STATION

(75) Inventors: Claus D. Emmer, Prior Lake, MN (US); Thomas Drube, Lakeview, MN (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 10/133,990

(22) Filed: Apr. 26, 2002

(65) Prior Publication Data

US 2003/0005709 A1 Jan. 9, 2003

Related U.S. Application Data

(60) Provisional application No. 60/286,558, filed on Apr. 26, 2001.

(51) Int. Cl.[7] ..... F17C 1/00; F17C 13/00

(52) U.S. Cl. ..... 62/45.1; 220/560.1

(58) Field of Search ..... 62/45.1; 220/560.1; 222/3

(56) References Cited

U.S. PATENT DOCUMENTS 3,050,951 A * 8/1962 Gebien ..... 62/45.1
4,376,489 A * 3/1983 Clemens ..... 62/45.1
5,005,362 A * 4/1991 Weltmer, Jr. et al. ..... 62/45.1
5,140,821 A * 8/1992 Fauske ..... 62/45.1
5,682,750 A 11/1997 Preston et al.
6,360,545 B1 * 3/2002 Goldstone et al. ..... 62/45.1

* cited by examiner

*Primary Examiner*—William C. Doerrler
(74) *Attorney, Agent, or Firm*—Piper Rudnick LLP

(57) ABSTRACT

A portable self-contained liquid natural gas (LNG) dispensing system is housed in a container featuring opposing side and end walls and a bottom panel. The container is divided into a ventilated portion and a covered portion. A roof is over the covered portion while the ventilated portion features an open top. A bulk tank positioned within the container contains a supply of LNG with a head space thereabove and a pump is submerged in LNG within a sump that is also positioned within the container and communicates with the bulk tank. The container is lined with stainless steel sheets to define a containment volume that is capable of holding the entire supply of LNG in the bulk tank. A vent valve communicates with the head space of the bulk tank and is positioned under the open top of the ventilated portion of the container. The electric controls are positioned on the lower portion of the end wall of the covered portion of the container so as to be located in accordance with the appropriate safety guidelines.

20 Claims, 3 Drawing Sheets

CONTAINMENT MODULE FOR TRANSPORTABLE LIQUID NATURAL GAS DISPENSING STATION

CLAIM OF PRIORITY

This application claims priority from U.S. Provisional Patent Application No. 60/286,558, filed Apr. 26, 2001, currently pending.

BACKGROUND OF THE INVENTION

The invention relates generally to cryogenic liquid dispensing stations and, more specifically, to portable self-contained dispensing stations for liquid natural gas.

Interest in the use of liquid natural gas (LNG) as a fuel for motor vehicles has increased dramatically in recent years. Entire fleets of government and industrial vehicles have successfully been converted to natural gas. Some privately-owned vehicles have been converted as well. Congress has passed an energy bill that requires increased use of alternative fuels in government and private fleets. Several factors have influenced this increasing use of LNG as a fuel in motor vehicles. LNG is relatively inexpensive. In addition, it burns very cleanly, making it much easier for fleets to meet more restrictive pollution emission standards.

LNG is stored and dispensed as a liquid because such an arrangement reduces the space necessary to contain the fuel in the dispensing station and the vehicle. An LNG fueling facility typically includes a large LNG storage tank and a dispensing system. Given that LNG is a cryogenic fluid, and thus has a boiling point below −150° F., the tank must be well insulated. In addition, the dispensing system must be capable of delivering LNG in a homogenous liquid phase so that accurate metering occurs and the maximum amount of fuel is stored in the vehicle's tank.

Pilot programs for testing and demonstration of the viability of LNG as an alternative fuel require pilot dispensing stations. Because of the unique storage requirements for LNG, it is impractical and economically unfeasible to modify existing gasoline facilities for LNG. It is therefore advantageous to minimize the capital investment in site improvements required to install LNG pilot dispensing stations since it is difficult to recapture such outlays during the relatively short life of the facility. An ideal LNG dispensing station thus will be one that is portable and self-contained to permit quick transport and installation at different distribution sites. Such a station would also permit fluid delivery and accurate metering to be initiated almost instantly.

In addition, National Fire Protection Association (NFPA) guidelines (NFPA 59A, Para 108) for spill containment require impounding areas that hold the entire LNG capacity of the station in the event of a catastrophic spill. Furthermore, in accordance with NFPA guidelines, electrical controls must either be designed for explosion-proof conditions or be situated in a safe area that is outside of the Division 1 and Division 2 areas illustrated in FIG. 1 at 8 and 9, respectively. Explosion-proof controls are costly. As a result, the latter option is preferable.

In response to the above demands, the filling station of commonly owned U.S. Pat. No. 5,682,750 to Preston et al. was developed. Such a station, which is marketed under the name QRS by Chart Inc. of Burnsville, Minn., provides a moveable skid constructed of a welded I-beam framework that is configured in a rectangular box shape. The side walls of the framework are formed of vertically positioned I-beams, cross members and metal fencing. Metal panels are fastened around the bottoms of the side walls to form what is essentially a stainless steel "bathtub."Mounted upon the framework is a bulk storage tank and an instant-on delivery system wherein the system pump and meter are mounted within a sump. The sump is flooded with LNG so that the pump and meter are maintained at the proper temperature for instant-on operation.

While the system of the Preston et al. '750 patent performs very well and is very effective, its manufacturing cost is quite high. A demand thus exists for a lower-cost portable self-contained LNG dispensing station. A demand also exists for a portable self-contained LNG dispensing station that fits within a standard sized container so that it may be shipped on equipment available throughout the world.

Accordingly, it is an object of the present invention to provide a portable self-contained LNG dispensing station that permits quick transport and installation at different distribution sites.

It is another object of the present invention to provide a portable self-contained LNG dispensing station that permits dispensing to be initiated almost instantly.

It is another object of the present invention to provide a portable self-contained LNG dispensing station that meets safety guidelines for spill containment and electrical controls positioning.

It is another object of the present invention to provide a portable self-contained LNG dispensing station that does not require explosion-proof electrical controls and equipment.

It is still another object of the present invention to provide a portable self-contained LNG dispensing station that is economical to manufacture.

It is still another object of the present invention to provide a portable self-contained LNG dispensing station that may be shipped on equipment available throughout the world.

SUMMARY OF THE INVENTION

The present invention is directed to a portable self-contained dispensing station for dispensing LNG to motor vehicles. The station features a container, preferably an ISO container, having a pair of opposing side walls, a pair of opposing end walls and a bottom panel. The bottom panel, opposing side walls and opposing end walls of the container are lined with stainless steel sheets so that cryogenic liquid does not leak out of the container. The lined container defines a spill containment volume that is sized to hold all of the supply of LNG in the bulk tank of the dispensing station. The container is divided into a ventilated portion and a covered portion with the covered portion including a roof positioned thereon in opposition to the bottom panel and the ventilated portion including an open top.

A bulk tank is positioned within the container and contains a supply of cryogenic liquid with a head space thereabove. A vent valve is in communication with the head space of the bulk tank and positioned beneath the open top of the ventilated portion of the container. A pump is positioned within the container and in communication with the bulk tank so that when the pump is activated, LNG is dispensed from the dispensing station. A sump that is in communication with the bulk tank receives LNG and the pump is submerged in the LNG so as to avoid two-phased flow therethrough.

An electric control panel for operating the pump, microprocessor and the automated valves of the dispensing station is positioned on a lower portion of the end panel of the covered portion of the container so as to be in an area permitted by NFPA guidelines.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

It is to be understood that while the dispensing station of the present invention is described below in terms of a station for dispensing LNG to motor vehicles, the present invention encompasses a system that may be used to dispense a variety of alternative cryogenic liquids to a variety of alternative use devices.

Figure 2:
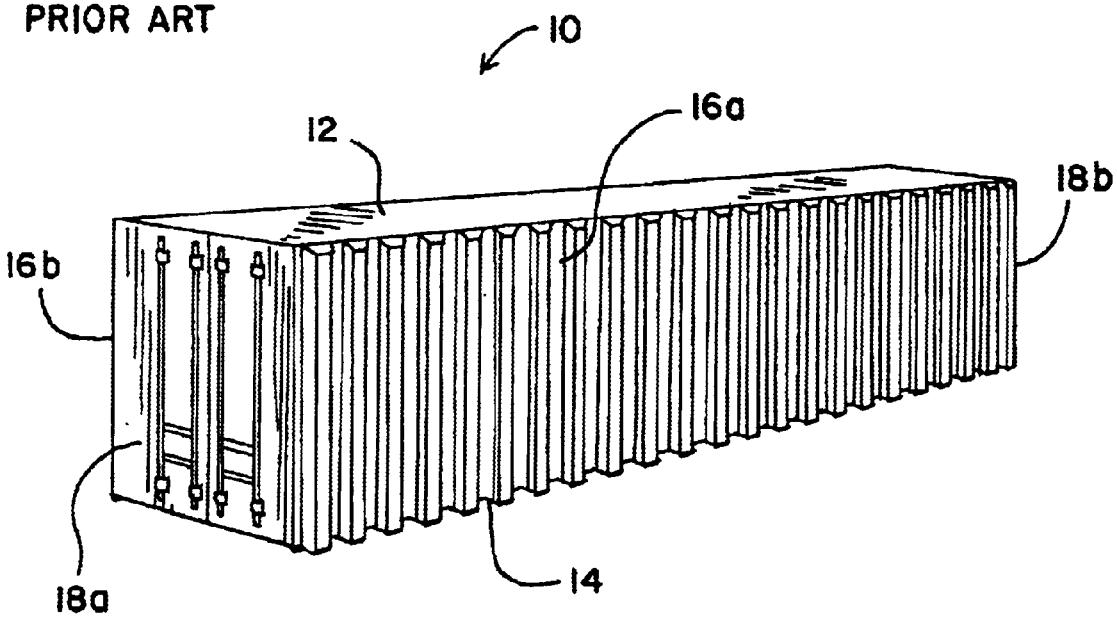
FIG. 2 PRIOR ART
FIG. 2 is a perspective view of a standard commercial container.

With reference to FIG. 2, an International Organization for Standardization (ISO) 40' container is indicated in general at 10. The container includes top and bottom panels 12 and 14, respectively, as well as opposing sides walls 16*a* and 16*b* and opposing end walls 18*a* and 18*b*. The top and bottom panels and opposing side and end walls are constructed primarily of steel and, when modified as described below, provide a protective envelope, containment area and shipping container for the dispensing station components positioned therein.

Figure 4:
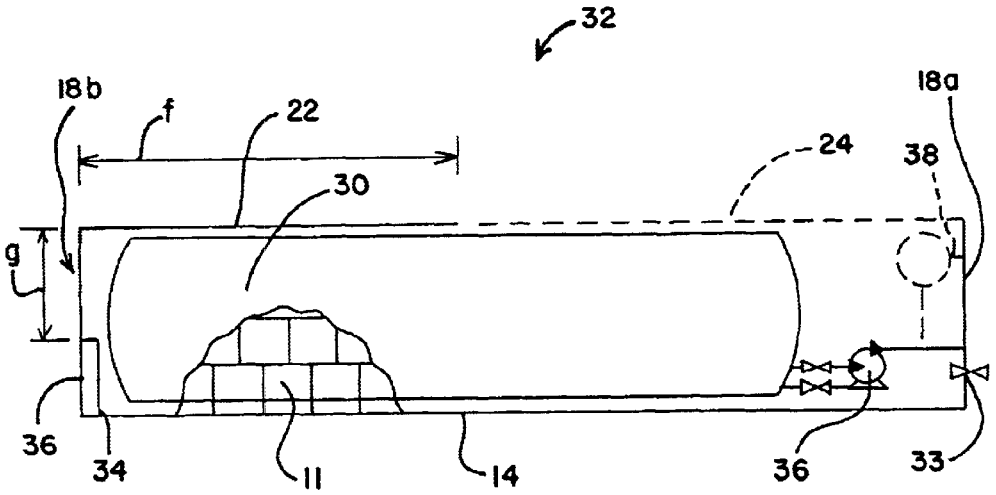
FIG. 4 is a side elevational view of an embodiment of the dispensing station of the present invention.

The container 10 is modified by lining its interior with thin sheets of stainless steel, indicated at 11 in FIG. 4. The sheets are welded to the interiors of the bottom panel 14, the opposing side walls 16*a* and 16*b* and end walls 18*a* and 18*b* in a liquid-tight fashion. While stainless steel sheets are preferred, alternative lining materials and arrangements that are capable of containing LNG may be used instead.

The sheets on the side and end walls are dimensioned to define a spill containment volume which preferably is equal to the volume of the bulk tank of the dispensing station. As a result, in the event of a catastrophic leak of the LNG from the bulk tank, the bottom panel and walls of the container act as a dyke so that LNG is prevented from overflowing into the area near the dispensing station, thereby maintaining the safety of the surrounding area and personnel.

While the dispensing station of the present invention addresses the spill containment issues in the fashion described above, the issue of bringing electric power to the station still exists. The embodiment of the dispensing station of the present invention described herein has a power requirement of 440V with a 3-phase current. As described above, the related electrical components and controls must be either separated from free flowing LNG, in either liquid or vapor form, by a distance specified by NFPA guidelines or, alternatively, explosion-proof boxes, wiring and equipment must be provided.

Figure 1:
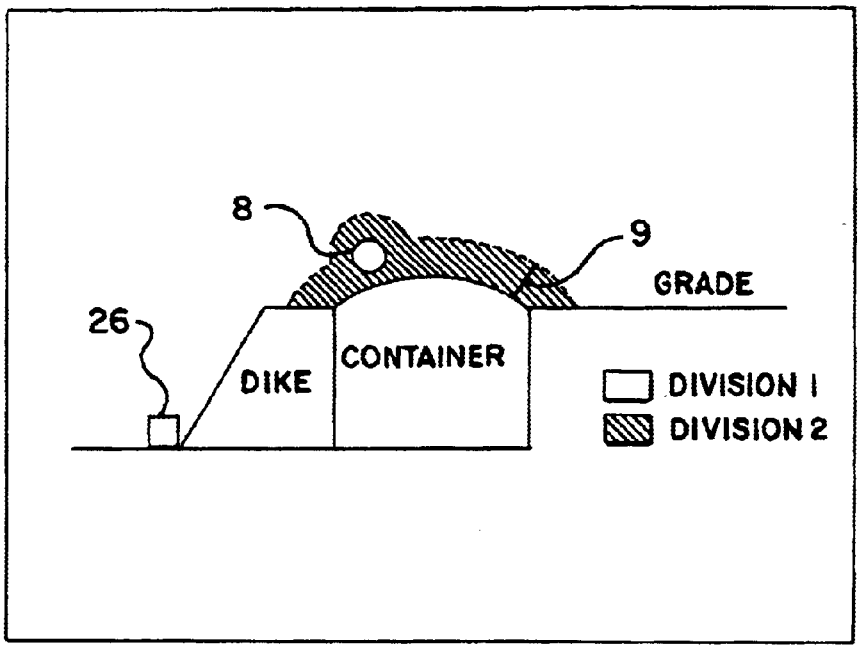
FIG. 1 PRIOR ART
FIG. 1 is a side elevational view from NFPA 59A showing a container with a liquid level below grade or the top of a dyke.
Figure 3:
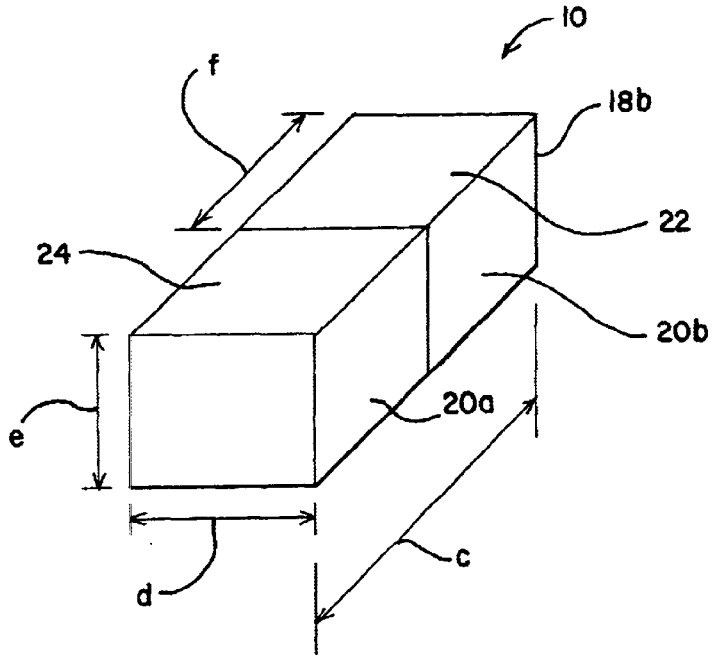
FIG. 3 is a simplified perspective view of the container of FIG. 2 as modified in accordance with the present invention.

Providing explosion-proof boxes, wiring and equipment is quite costly. As a result, the dispensing station of the present invention employs a novel configuration that provides a container construction and location for the electrical components and controls that provide the required spacing. More specifically, as illustrated in FIG. 3, the container 10 of FIG. 1 is divided into two portions: a ventilated portion 20*a* and a covered portion 20*b*. Covered portion 20*b* is provided with a roof 22. In contrast, ventilated portion 20*a* features an open top 24. As will be described below, the ventilated portion of the container 10 contains the plumbing associated with tank venting so that vented LNG vapor, which is primarily methane and thus lighter than air, can rise safely away while the electrical components and controls are placed a safe distance away in a sealed cabinet near the bottom of the end panel 18*b* of covered portion 20*b*. Such a location corresponds to the position indicated at 26 in FIG. 1, which is clearly outside of the forbidden areas 8 and 9.

With reference to FIG. 3, sample dimensions for the container would be approximately forty feet in length (indicated at c), eight feet in width (indicated at d) and eight and half feet in height (indicated at e). For such container dimensions, the length of the roof 22 of the covered portion 20*b* (indicated at f) should be approximately fifteen feet.

As illustrated in FIG. 4, a bulk tank 30 and various other components are positioned within the container 10 of FIGS. 2 and 3 to form the embodiment of the dispensing station of the present invention indicated in general at 32 in FIG. 4. For the container dimensions presented with respect to FIG. 3, bulk tank 30 has a capacity of approximately 6,000 gallons and a maximum working pressure of 175 psig. The bulk tank may be refilled via fill fitting 33 positioned in end wall 18*a*.

As will be described in greater detail below, the bulk tank communicates with, and provides LNG to, a sump 36 containing a pump, preferably of the two-stage variety. The pump is submerged within the LNG contained in the sump so that it is cooled to the approximate temperature of the LNG being dispensed. This prevents the occurrence of two-phase flow of LNG in the pump so that nearly 100% liquid phase LNG is dispensed by the system.

An optional sump containing a meter, indicated at 38 may be provided. The sump 38 communicates with the pump sump 36 so that it is also filled with LNG. As a result, the meter within sump 38 is pre-cooled so that LNG entering it is not vaporized. This results in more accurate metering. The meter may optionally be placed within the same sump 36 as the pump and submerged within the LNG contained therein. The provision of the pump and meter sumps 36 and 38 permit the dispensing station 32 to dispense LNG without a cool-down period and thus nearly instantly upon activation.

The electrical control panel and associated components 34 for the station are positioned on the lower portion 36 of end panel 18*b*, preferably in a sealed cabinet. As described previously, this corresponds to the location indicated at 26 in FIG. 1 so that expensive explosion-proof boxes, wiring and equipment are avoided. As an example, the distance between the top of the control panel 36 and the container, indicated at g in FIG. 4, would preferably be approximately five feet.

Figure 5:
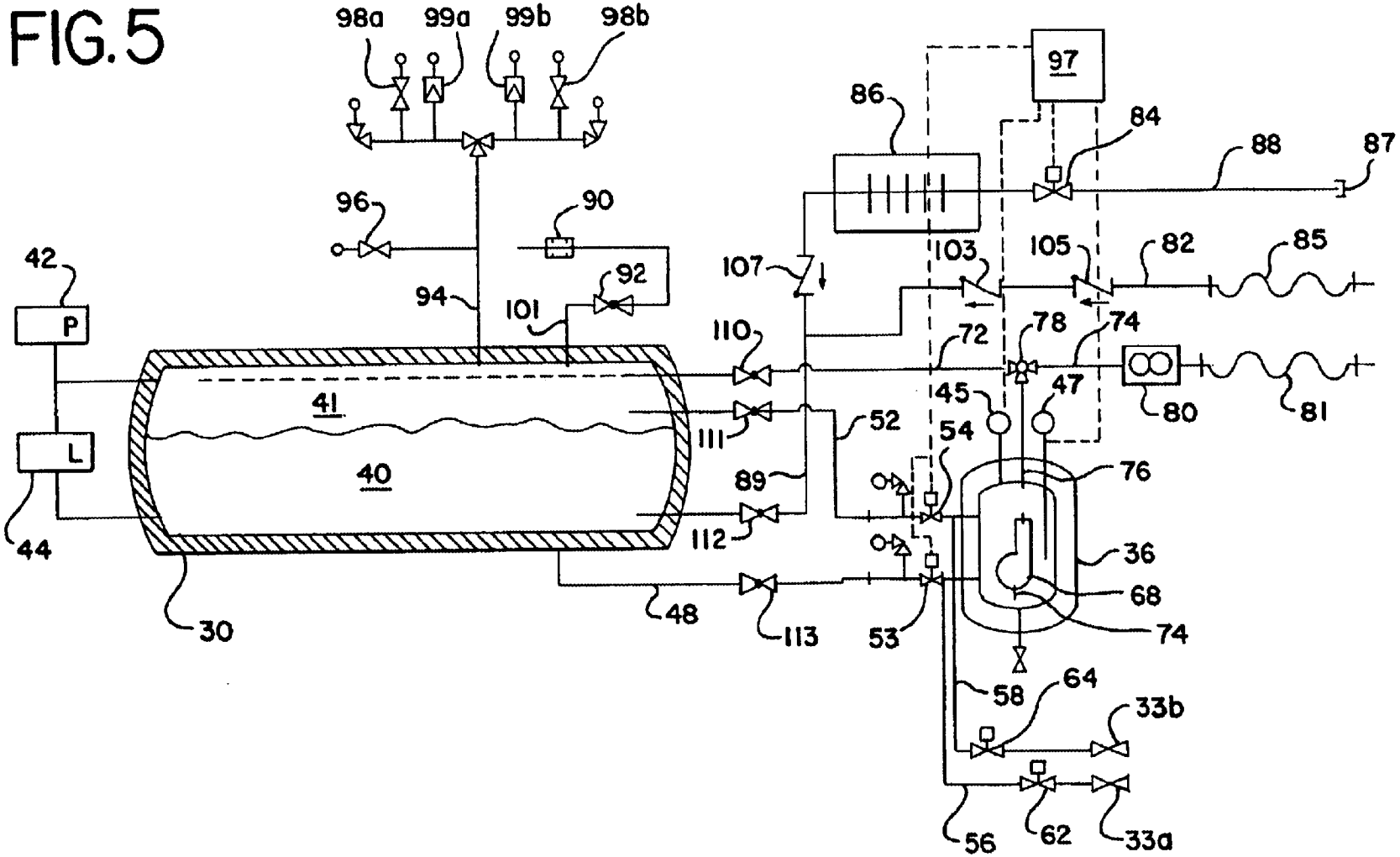
FIG. 5 is a schematic of the dispensing station of FIG. 4.

FIG. 5 is a schematic of the dispensing station of FIG. 4. The bulk tank 30 is insulated, preferably with a double-walled construction with a vacuum space between the two walls. Tank 30 contains a supply of LNG 40 with a gas head or vapor space 41 above it. The pressure and liquid level of the LNG in the tank is measured via pressure and liquid level gauges 42 and 44, respectively.

Liquid feed line 48 and vapor return line 52 permit LNG to flow from tank 30 to sump 36. Lines 48 and 52 are vacuum insulated in a known manner, to prevent heat transfer to the LNG. Inlet valve 53 controls the flow of LNG in line 48. A valve 54 is provided for initiating or stopping vapor flow from sump 36 through line 52. Sump 36, which has a double-walled structure like that of tank 30, is disposed below tank 30 such that LNG flows by gravity from bulk tank 30 to the sump 36 when valves 53 and 54 are open. Thus, sump 36 is constantly filled with LNG, as long as LNG is present in bulk storage tank 30 and valves 53 and 54 are open. The pressure and temperature of the LNG within sump 36 may be measured by pressure and temperature sensors 45 and 47, respectively. Valves 53 and 54 are preferably air actuated so as to be automated and controllable by a microprocessor 97 and control panel 34 (FIG. 4).

Refill lines 56 and 58 permit the bulk tank 30 to be refilled from a delivery tanker truck. More specifically, the filling procedure involves isolating the sump 36 from the bulk tank 30 by closing the vent return valve 54 and liquid feed valve 53 and connecting the delivery tanker truck discharge line to fitting 33*a* and the vapor recovery line to fitting 33*b*. Valves 62 and 64 are then opened so as to allow liquid from the tanker truck to gravity feed the sump 36.

Valve 92 may be manually opened as the bulk tank is being refilled. This permits vapor from the tank 30 to pass through an audible "whistle" type device 90 as the liquid level therein rises. When the liquid level reaches the level of line 101, liquid LNG passes through the device 90 so that the audible signal ceases. As a result, 90, 92 and 101 provide an audible indication relating to the fill-status of the bulk tank. Suitable audible and visual devices and arrangements that may be used for device 90 are disclosed in commonly-owned U.S. application Ser. No. 10/085,315, filed Feb. 28, 2002 and currently pending.

Pump 68 is submerged in the LNG contained in sump 36. The inlet 74 of pump 68 communicates with the LNG in the sump and the outlet 76 of pump 68 is connected to junction 78 which directs LNG from the pump through either bulk tank return line 72 or LNG delivery line 74, the latter of which includes meter 80 and through which LNG is delivered to the vehicle tank through dispensing hose 81.

LNG in the bulk tank may be saturated by connecting hose 81 to line 88 after removing cap 87. This causes LNG pumped from sump 36 by pump 68 to flow through heat exchanger 86. Ambient air warms the LNG flowing through the heat exchanger 86 and the warmed LNG is returned to the tank 30 through line 89 and check valve 107. Valve 84 preferably is air actuated and closed automatically by a system microprocessor 97 when the temperature detected by temperature sensor 47 reaches a predetermined setting for saturation.

Hose 85 may be connected to a vehicle tank prior to dispensing hose 81 if the pressure in the vehicle tank is too high to be filled by pump 68. The vapor in the vehicle tank flows through line 82 and check valves 103 and 105 to the bulk tank 30 so that the pressure in the vehicle tank is relieved. Hose 84 is then removed from the vehicle and hose 81 is inserted so that the vehicle fill process may commence.

If the pressure within the head space 41 of tank 30 becomes too great, LNG gas may be released through vent line 94 which leads to vent valves 96, 98*a*, 98*b*, 99*a* and 99*b*. As described above, the vent valves are positioned beneath the open top 24 of the ventilated portion 20*a* of the container 10 of FIGS. 3 and 4.

Valves 110–113 are manually-operated service valves that remain open during normal operation of the dispensing station.

The configuration of automated valves 53, 54 and 84, the operation of microprocessor 97 and the operation of the pump 68 may be directed via the controls 34 illustrated in FIG. 4. The dispensing station may optionally be provided with an alarm system that uses standard methane detectors for gas detection and tracer hose for fire sensing. Alarm events will close a contact to which a signaling device may be attached.

The present invention thus provides a portable dispensing station that is self-contained and easily set up. It can be pre-tested at the factory and delivered ready to use. The costs of explosion-proof equipment can be avoided and, given that the station is packaged within an ISO container, it may be shipped on equipment available throughout the world.

While the preferred embodiments of the invention have been shown and described, it will be apparent to those skilled in the art that changes and modifications may be made therein without departing from the spirit of the invention, the scope of which is defined by the appended claims.

What is claimed is:

1. A container for a self-contained cryogenic liquid dispensing station comprising:

a)a pair of opposing side walls, a pair of opposing end walls and a bottom panel;

b)said bottom panel, opposing side walls and opposing end walls of said container lined with a lining material so that cryogenic liquid does not leak out of the container;

c) a top panel opposing said bottom panel and including roof portion and an open top portion; and d) an electric control panel adapted to configure and operate a the dispensing station positioned upon a lower portion of the end panel that is adjacent to the roof portion of the top panel.

2. The container of claim 1 wherein said lining material includes stainless steel sheets.

3. The container of claim 2 wherein the stainless steel sheets are welded to the bottom panel and side and end walls of said container.

4. The container of claim 1 wherein the dispensing system includes a bulk tank positioned within said container and the bulk tank contains a supply of the cryogenic liquid and the lining material of the container defines a spill containment volume that is sized to hold all of the cryogenic liquid in the bulk tank.

5. The container of claim 4 wherein the bulk tank includes a head space and a vent valve in communication with the head space with said vent valve positioned beneath the open top of the container.

6. The container of claim 5 wherein the dispensing station includes a pump that is in communication with the bulk tank and the electric control panel so that the pump may be operated via the electric control panel.

7. The container of claim 1 wherein the dispensing station includes a plurality of automated valves that communicate with said electric control panel so that the dispensing station may be via the electric control panel.

8. A self-contained dispensing station for storing and dispensing cryogenic liquid to a use device comprising:

a) a container featuring a pair of opposing side walls, a pair of opposing end walls and a bottom panel b) said bottom panel, opposing side walls and opposing end walls of said container lined with a lining material so that cryogenic liquid does not leak out of the container;

c) said container divided into a ventilated portion and a covered portion with said covered portion including a roof positioned thereon in opposition to said bottom panel and said ventilated portion including an open top;

d) a bulk tank positioned within said container and containing a supply of cryogenic liquid with a head space thereabove;

e) a vent valve in communication with the head space of said bulk tank and positioned beneath the open top of the ventilated portion of the container; and f) an electric control panel adapted to control and operate the dispensing station positioned on a lower portion of the end panel of the covered portion of the container.

9. The dispensing station of claim 8 wherein said lining material includes stainless steel sheets.

10. The dispensing station of claim 9 wherein the stainless steel sheets are welded to the bottom panel and side and end walls of said container.

11. The dispensing station of claim 8 wherein the lining material of the container defines a spill containment volume that is sized to hold all of the supply of cryogenic liquid in the bulk tank.

12. The dispensing station of claim 8 further comprising a pump that is in communication with the bulk tank and the electric control panel so that the pump may be operated via the electric control panel.

13. The dispensing station of claim 12 further comprising a dispensing hose with a meter in circuit between the dispensing hose and said pump.

14. The dispensing station of claim 8 wherein the container is an ISO container.

15. A self-contained dispensing station for storing and dispensing cryogenic liquid to a use device comprising:

a) a container featuring a pair of opposing side walls, a pair of opposing end walls and a bottom panel;

b) said bottom panel, opposing side walls and opposing end walls of said container lined with a lining material so that cryogenic liquid does not leak out of the container;

c) said container divided into a ventilated portion and a covered portion with said covered portion including a roof positioned thereon in opposition to said bottom panel and said ventilated portion including an open top;

d) a bulk tank positioned within said container and containing a supply of cryogenic liquid with a head space thereabove;

e) a vent valve in communication with the head space of said bulk tank and positioned beneath he open top of the ventilated portion of the container;

f) a pump position within the container and in communication with said bulk tank so that when said pump is activated, cryogenic liquid is dispensed from the dispensing station; and g) an electric control panel for operating the pump positioned on a lower portion of the end panel of the covered portion of the container.

16. The dispensing station of claim 15 wherein said lining material includes stainless steel sheets.

17. The dispensing station of claim 16 wherein the stainless steel sheets are welded to the bottom panel and side and end walls of said container.

18. The dispensing station of claim 15 wherein the lining material of the container defines a spill containment volume that is sized to hold all of the supply of cryogenic liquid in the bulk tank.

19. The dispensing station of claim 15 further comprising a sump that is in communication with the bulk so as to receive cryogenic liquid therefrom and wherein said pump is submerged in said cryogenic liquid so as to avoid two-phased flow therethrough.

20. The dispensing station of claim 15 wherein the container is an ISO container.

* * * * *

UNITED STATES PATENT AND TRADEMARK OFFICE

CERTIFICATE OF CORRECTION

PATENT NO. : 6,640,554 B2
DATED : November 4, 2003
INVENTOR(S) : Claus D. Emmer et al.

It is certified that error appears in the above-identified patent and that said Letters Patent is hereby corrected as shown below:

Column 6,
Line 31, delete "operate a the dispensing station positioned upon a" and insert therefor:
-- operate a dispensing station positioned upon a --
Line 57, delete "may be via the electric control panel" and insert therefor:
-- may be operated via the electric control panel --
Line 61, delete "panel" and insert therefor: -- panel; --

Column 8,
Line 12, delete "said bulk tank and positioned beneath he open top of" and insert therefor: -- said bulk tank and positioned beneath the open top of --
Line 31, delete "a sump that is in communication with the bulk so as to" and insert therefor: -- a sump that is in communication with the bulk tank so as to --

Signed and Sealed this

Thirteenth Day of July, 2004

JON W. DUDAS
*Acting Director of the United States Patent and Trademark Office*